US006416330B1

(12) United States Patent
Yatskov et al.

(10) Patent No.: US 6,416,330 B1
(45) Date of Patent: Jul. 9, 2002

(54) CANTED COIL SPRING CONDUCTOR ELECTRICAL CIRCUIT CONNECTOR

(75) Inventors: Alexander I. Yatskov, Kenmore; Stephen V. R. Hellriegel, Bainbridge Island; Richard K. Kunze, Woodinville, all of WA (US)

(73) Assignee: Cray Inc., Seattle, WA (US)

( * ) Notice: Subject to any disclaimer, the term of this patent is extended or adjusted under 35 U.S.C. 154(b) by 0 days.

(21) Appl. No.: 09/617,151

(22) Filed: Jul. 17, 2000

(51) Int. Cl.[7] ..... H01R 9/09
(52) U.S. Cl. ..... 439/65; 439/840; 439/66
(58) Field of Search ..... 439/66, 245, 840, 439/74, 591; 29/845, 876, 884, 65; 361/784, 785, 788, 792, 807

(56) References Cited

U.S. PATENT DOCUMENTS

| | | | | |
|---|---|---|---|---|
| 4,462,657 A | * | 7/1984 | Snowdon et al. | 439/256 |
| 4,810,213 A | * | 3/1989 | Chabot | 439/825 |
| 4,893,795 A | | 1/1990 | Balsells | 267/1.5 |
| 4,934,666 A | | 6/1990 | Balsells | 267/1.5 |
| 5,035,628 A | | 7/1991 | Casciotti et al. | 439/66 |
| 5,061,191 A | | 10/1991 | Casciotti et al. | 439/66 |
| 5,092,781 A | | 3/1992 | Casciotti et al. | 439/62 |
| 5,139,243 A | | 8/1992 | Balsells | 267/167 |
| 5,139,276 A | | 8/1992 | Balsells | 277/163 |
| 5,273,438 A | | 12/1993 | Bradley et al. | 439/66 |
| 5,402,313 A | | 3/1995 | Casperson et al. | 361/710 |
| 5,505,626 A | | 4/1996 | Grabbe et al. | 439/62 |

* cited by examiner

*Primary Examiner*—Tho D. Ta
*Assistant Examiner*—Phuongchi Nguyen
(74) *Attorney, Agent, or Firm*—Seed Intellectual Property Law Group PPLC

(57) ABSTRACT

A canted coiled spring is used as a highly conductive, high current electrode between a printed circuit board and a conductive strip connected to a selected voltage. A conductive channel member has fixed therein a coil spring made of a highly conductive, metallic material. The canted coiled spring is fixed at each end so that it may be easily slid along an adjacent electrode of the power strip. The channel member holding the canted coiled spring is coupled to a printed circuit board with a clamped, highly conductive contact surface. The use of the coil spring in a channel member connected to a printed circuit board permits the printed circuit board to be easily slid into, and out of electrical contact with power carrying electrodes.

16 Claims, 11 Drawing Sheets

CANTED COIL SPRING CONDUCTOR ELECTRICAL CIRCUIT CONNECTOR

TECHNICAL FIELD

This invention relates to electrical connectors, and more particular to electrical connectors for coupling circuits on circuit substrates, such as printed circuit boards.

BACKGROUND OF THE INVENTION

Many computing devices, such as desktop computers, workstations, main-frame and super-computers employ multiple printed circuit boards ("PCB") that include various microprocessors, printed circuits and other components that must be electrically coupled together to transmit data and/or power. The electrical traces on one or more layers of the PCB form the printed circuits and typically terminate in one or more terminals or contacts for making connections. A single failed or intermittent connection can result in large amounts of "down-time" for the computing device, and costly troubleshooting by highly skilled technicians.

Highly parallel processing super-computers present a particularly significant problem in terms of space constraints. These computers rely on a high number of connections between circuit boards that each carry one or more microprocessors. The nature of parallel processing places high demands on the timing of signals, including clock signals across the various computer components. In an effort to improve the timing of the signals, the PCBs are spaced relatively closely together to reduce the length of the connections between the PCBs. The tight spacing hinders the ability of technicians to access particular computer components, such as the PCBs and electrical connectors. This presents a particular problem to computer manufacturers and owners who desire a modular design that permits failed components to be quickly and easily replaced. If serviceable, a modular design would also permit the addition of new or additional processors as desired, for example when more processing power is required or when the processors become more affordable. This could significantly extend the life of the computing device.

A highly reliable and precise electrical connector is required to couple circuits between printed circuit boards, particularly for providing a supply voltage to the circuits. Additionally the connection should not cause significant voltage drops.

SUMMARY OF THE INVENTION

According to principles of the present invention, an electrical connector includes a conductive channel surface in electrical communication with a canted coil spring conductor and a conductive contact surface, to couple circuits on a circuit substrate to a power supplying substrate.

According to one aspect of the invention, a channel in the channel member includes a single canted coil spring conductor.

In a further aspect of the invention, the contact surface is at an angle greater than 0° to an opening of the channel, to couple circuits on a circuit substrate to a nonparallel power supplying substrate. The angle can be 90° where the circuit substrate and power supplying substrate are perpendicular.

BRIEF DESCRIPTION OF THE DRAWINGS

In the drawings, identical reference numbers identify similar elements or acts. The sizes and relative positions of elements in the drawings are not necessarily drawn to scale and various elements and portions of elements may be are arbitrarily enlarged and positioned to improve drawing legibility.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with computers, printed circuit boards, circuits, mechanical clamps and electrical connectors have not been shown or described in detail to avoid unnecessarily obscuring descriptions of the embodiments of the invention.

Figure 1:
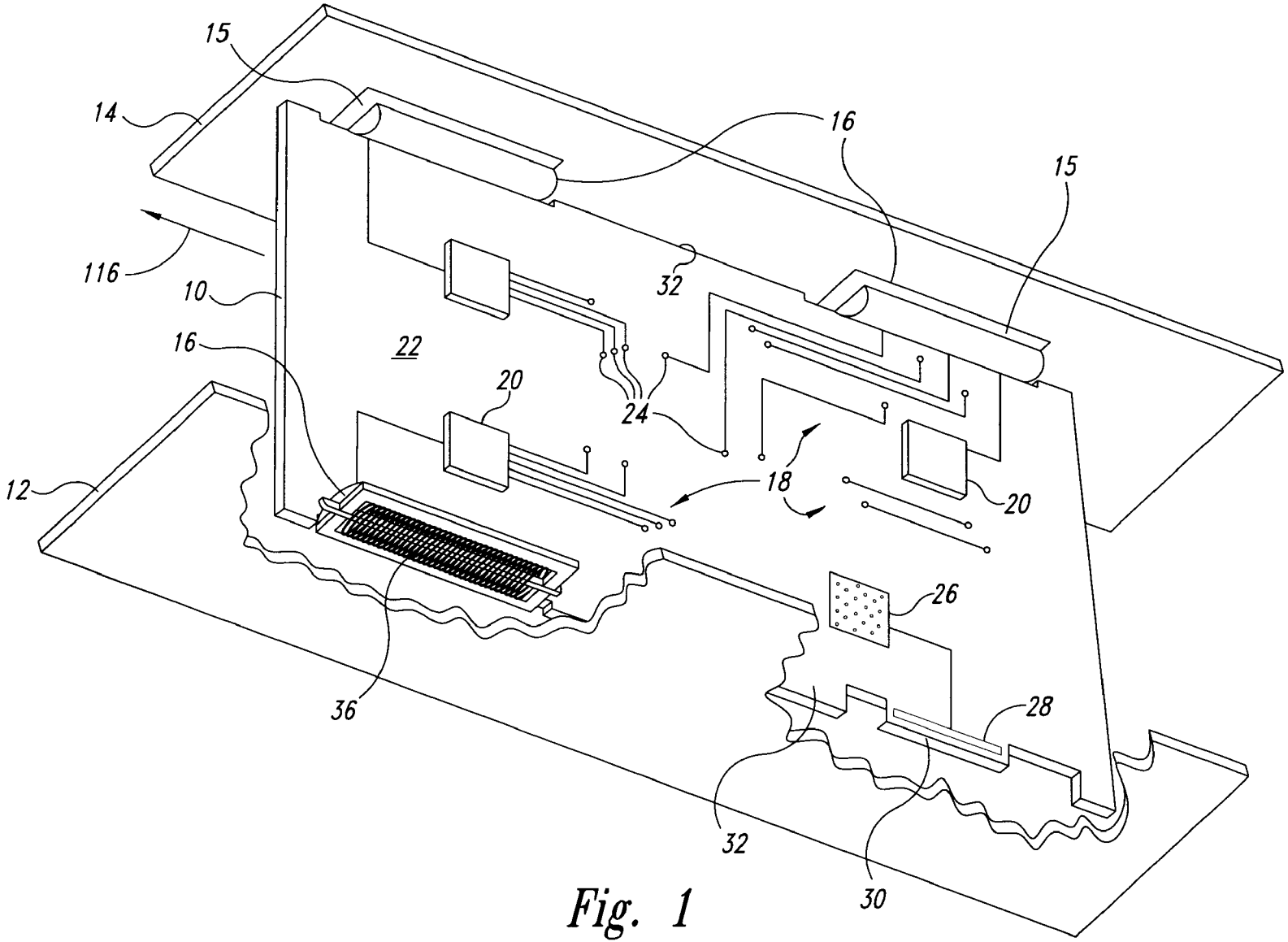
FIG. 1 is a top, front, right, broken isometric view of a set of electrical connectors according to the present invention coupling respective circuits on a printed circuit board to a pair of respective power source substrates.

FIG. 1 shows a circuit carrying substrate, such as a printed circuit board 10 ("PCB"), between a pair of electrical substrates, such as power supplying substrates 12, 14. (Portions of one of the power supplying substrate 12 are broken away to better illustrate the underlying structure.) A set of electrical connectors 16 electrically couple the circuits on the PCB 10 to power strip 15 on power supplying substrates 12, 14. (FIG. 1 omits one of the electrical connectors to better illustrate portions of the PCB 10 underlying the electrical connectors 16.) The PCB 10 is perpendicular to the power supplying substrates 12, 14, permitting the PCB 10 to easily slide in and out of engagement with the power supplying substrates 12,14. Power source strips 15 on the substrates carry electrical power that is transferred to the circuit via the connectors 16 and canted coil spring conductors 36.

The PCP 10 is formed from one or more layers of an insulating material, such as FR-4 epoxy-fiberglass laminate. The PCB 10 is typically sufficiently thick to form a rigid substrate, although minor amounts of bending or deflection can occur. The circuits take the form of electrically conductive circuit traces 18 (i.e., printed circuits) coupling various electrical and electronic components, such as microprocessors 20. FIG. 1 shows only a few of the circuit traces 18 on a surface 22 of the PCB 10, for purposes of illustration. Each layer of the PCB 10 can also carry circuit traces (not shown) where the PCB 10 is a laminate structure. Through-holes 24 can provide connections between the circuit traces 18 on the opposing surfaces 22 and/or inner layers of the PCB 10.

The PCB 10 also includes conductive areas (i.e., lands) to electrically couple the electrical and electronic components to the circuits. For example, FIG. 1 shows a bonding pad 26 to mount one of the microprocessors 20. (FIG. 1 omits the particular microprocessor to better illustrate the underlying bonding pad 26.) The bonding pad 26 can take the form of any conductor suitable for electrically coupling the particular electrical or electronic component to the circuits. For example, the bonding pad 26 can take the form of a ball grid array for direct attachment of integrated circuits ("ICs"). The bonding pad can alternatively take the form of through-holes for receiving leads from IC packages, or can take the form of other types of lands.

The PCB 10 further includes electrodes or electrical contacts 28 to couple the circuits to other electrical circuits, such as the power supplying substrates 12, 14. (FIG. 1 omits one of the electrical connectors 16 to better illustrate the underlying electrical contact 28.) The electrical contacts 28 can take the form of a conductive area on one or both surfaces 22 of the PCB 10. The electrical contacts 28 can be formed by depositing a conductive material on the PCB 10 as an integral part of forming the circuit traces 18. The electrical contacts 28 are on fingers 30 that extend from side edges 32 of the PCB 10 to facilitate the electrical and mechanical coupling. The fingers 30 can be formed by recessing portions of the edges 32 on either side of the fingers 30.

The power supplying substrates 12, 14 provide power from a power strip 15 that receives power from a voltage source (not shown) to the circuits on the PCB 10 through the strip 15 to the electrical connectors 16 and traces 18. The power supplying substrates 12, 14 can take the form of a conductive plate for the entire surface, or an insulating plate having a strip 15 of a conductive material on an outer surface. While shown as a plate, the power supplying substrates 12, 14 can take other forms. For example, the conductive portion can take the form of a linear rail that is conductive along the entire length. Similarly, the conductive portion can take the form of a trace or other contact region or strip 15 on a printed circuit board. Use of a large plate or rail assures electrical contact without regard to the precise position of the PCB 10 with respect to the power supplying substrates 12, 14.

Figure 2:
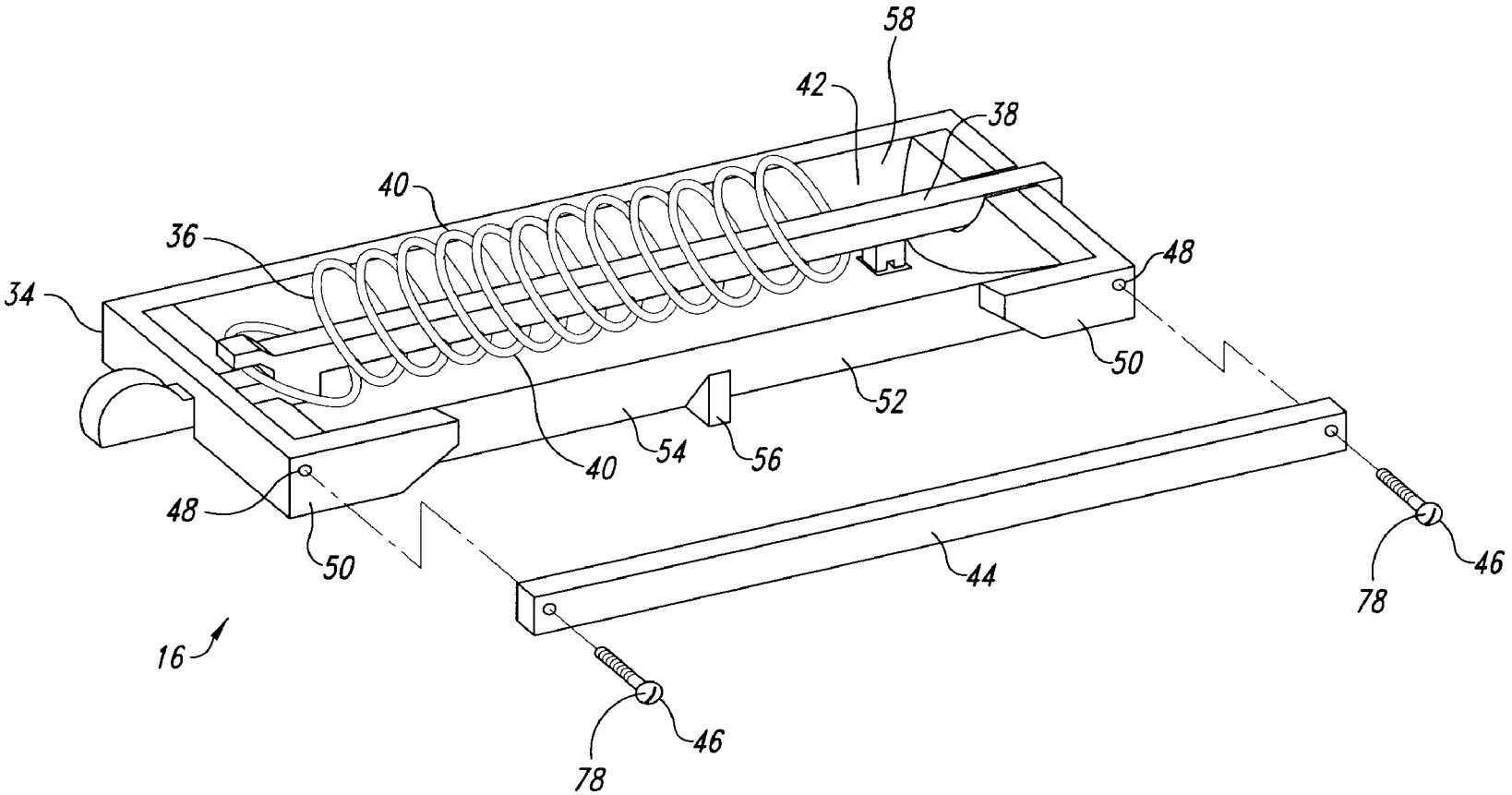
FIG. 2 is a bottom, right isometric view of the electrical connector according to the present invention, including a channel member having a channel, a canted coil spring conductor, a retainer and a clamp.
Figure 3:
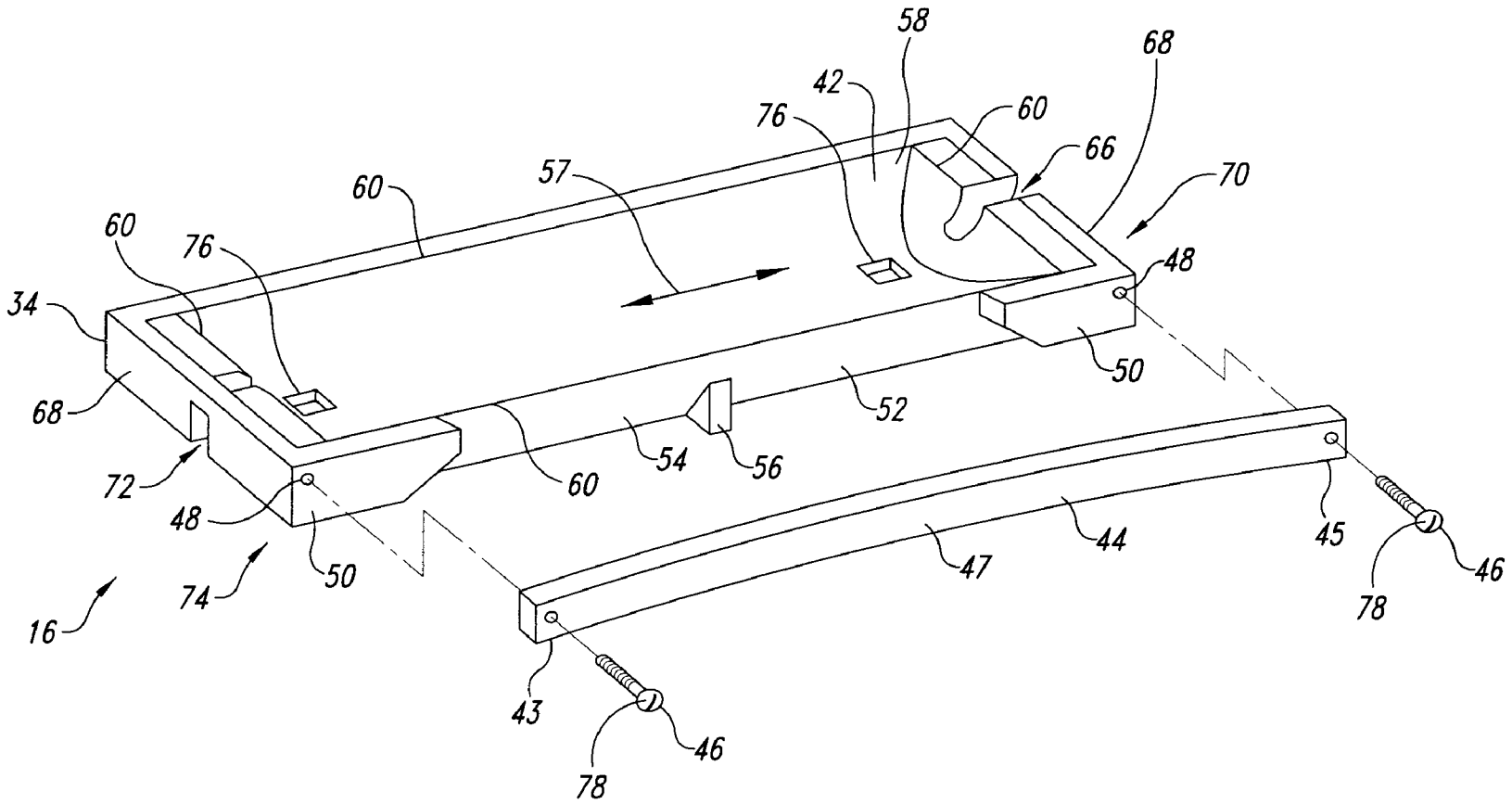
FIG. 3 is a bottom, right, exploded isometric view of the channel member without the canted coil spring conductor and retainer having a prestressed clamp bar.
Figure 4A:
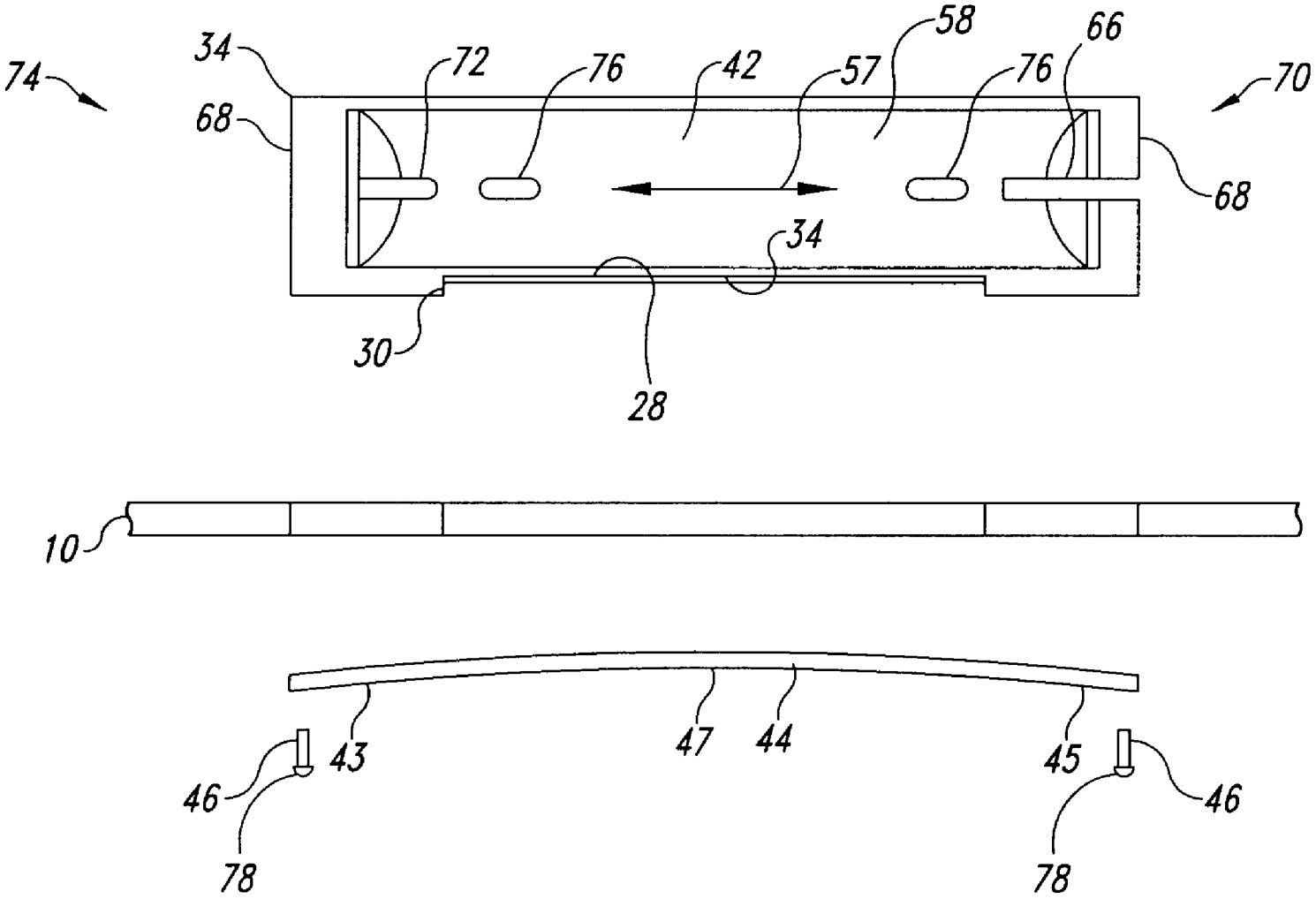
FIGS. 4A and 4B are top elevational views of the electrical connector of FIG. 3, with the canted spring conductor and the retainer removed to show the channel, and with the clamping member in an unclamped and clamped position, respectively, to secure the electrical connector to a portion of the circuit board.

FIG. 2 shows one of the electrical connectors 16, including an elongated channel member 34, a canted coil spring conductor 36 and a retainer 38 received through a perimeter 40 of the canted coil spring conductor 36 to secure the canted coil spring conductor 36 in a channel 42 of the channel member 34. The electrical connector 16 also includes a clamp member or clamp bar 44 and adjustment members, such as threaded fasteners 46. The clamp bar 44 is shown in FIG. 2 according to one embodiment of the invention. It may be pre-shaped with an arc, as shown in the embodiment of FIGS. 3 and 4A. later described. Threaded holes 48 in a bottom surface 50 of the channel member 34 receive the threaded portions of the fasteners 46 to secure the electrical connector 16 to the finger 30 of the PCB 10. The bottom surface 50 of the channel member 34 includes a recess 52 sized and dimensioned to receive the finger 30. A portion of the recessed bottom surface 50 forms a conductive contact surface 54. A leg 56 provides additional support when the channel member 34 is secured to finger 30 of the PCB 10.

FIG. 3 shows the channel member 34 without the canted coil spring conductor 36 and the retainer 38. The channel 42 has a longitudinal axis 57 extending along a length of the channel 42. At least a portion of the channel forms a conductive channel surface 58 that is in electrical communication with the contact surface 54. The conductive channel surface 58 has an elliptical contour or cross-section that matches the perimeter 40 of the canted coil spring conductor 36 in compressed state (shown best in FIG. 11). In the shown embodiment, the entire channel member 34, including the channel 42 and the contact surface 54, is a conductor, and can be integrally formed as a gold plated, aluminum and nickel die cast.

An opening 60 that forms the channel 42 in the channel member 34, defines a plane that is perpendicular to a plane defined by the contact surface 54 of the channel member 34. This aligns the contact surface 54 with the electrical contacts 28 on finger 30 when the canted coil spring conductor 36 aligns with the power supplying substrates 12, 14, that are perpendicular to the PCB 10. A different angle can subtend the planes defined by the opening 60 and the contact surface 54 where the PCB 10 and supplying substrates 12, 14 are not perpendicular to one another.

The channel member 34 includes an open slot 66 through a side wall 68 at a first end 70, and a closed slot 72 through the side wall 68 at a second end 74 for receiving respective portions of the retainer 38. The channel member 34 further includes a pair of apertures 76 in the bottom of the channel 42, sized to receive other portions of the retainer 38, as described below.

FIGS. 3 and 4A show the clamp bar 44 in a pre-shaped arc. It has a first end 43 and a second end 45 that through which the fasteners 46 will be positioned. The fasteners 46 will clamp the clamp bar 44 to the channel member 34 with the conductive contact 28 of the printed circuit board 10 therebetween. The force to retain tie clamp bar 44 is at the ends so the center portion 47 is pre-curved towards the channel member 34. Solder is placed between the channel member 34 and the conductive contact 28 on the board 10 (see FIG. 1). When clamp bar 44 is attached, pressure will be provided by the pre-shaped arc to the center portion 47 of the channel member 34. Pressure will also be applied at the ends 43 and 45 where the fasteners 46 attach. The pre-shaped arc in the clamp bar 44 ensures that even pressure, for fill electrical contact is provided along the entire length of the clamp bar 44 when it is attached.

Figure 4B:
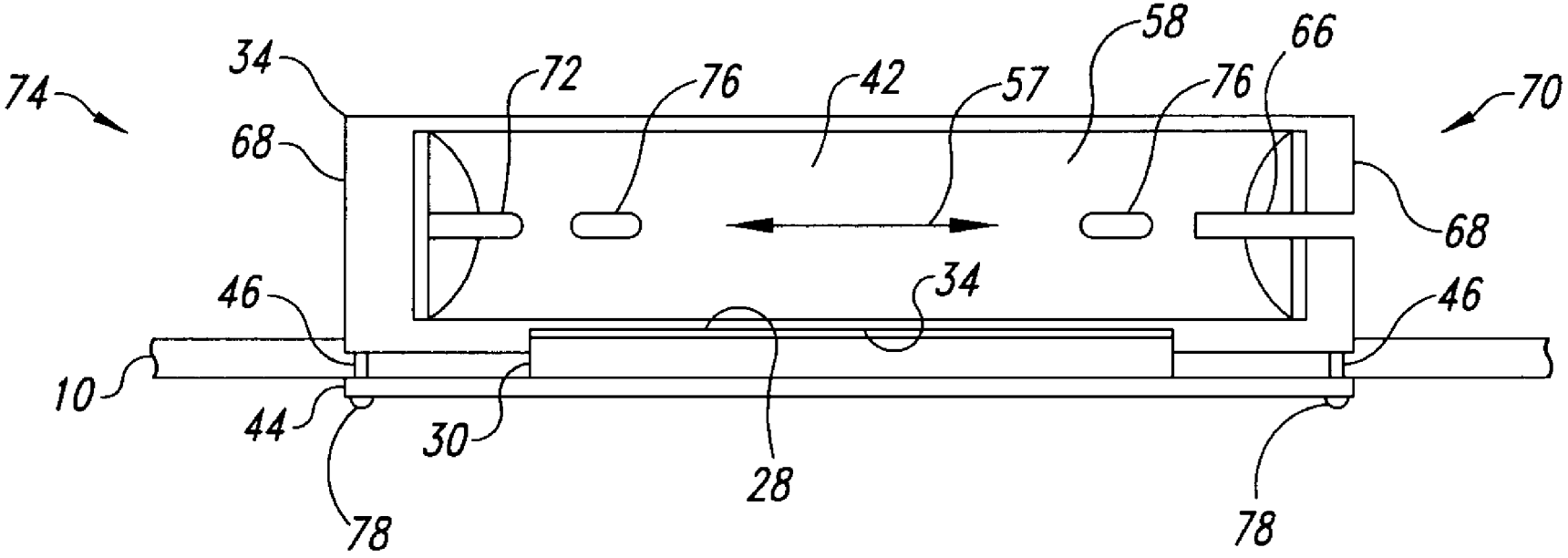

As can be seen by comparing FIGS. 4A and 4B, prior to the clamp bar 44 being attached, it is slightly curved, in an arc. The amount of arc is selected to be that which will provide even pressure to the channel member 34 when the bar is fastened and straight, as shown in FIG. 4B. Solder is applied between the channel member 34 and the conductor 28, after which the clamp bar 44 is connected to the channel member 34, with the board 10 having conductor 28 therebetween. The clamp bar 44 becomes straight and flat upon being connected, see FIG. 4B. The flat clamp bar 44, having the pre-shaped arc, will apply pressure in the center region 47 to ensure more solid electrical connection between the board 10 and the conductor 16 for extended periods of time. This will reduce solder creep and provide long term stability for the connection.

FIG. 4B shows the channel member 34 secured to the finger 30, where the recess 52 receives the finger 30 between the contact surface 54 of the channel member 34 and the clamp bar 44. A head 78 on each of the threaded fasteners 46 engages the clamp bar 44 and the thread of the threaded fasteners 46 engage the threaded holes 48 to selectively adjust a distance between the contact surface 54 of the channel member 34 and the clamp bar 44. Thus, tightening of the threaded fasteners 46 urges the clamp bar 44 toward the bottom surface 50 to effectively clamp the electrical connector 16 to the finger 30 of the PCB 10.

Figure 5:
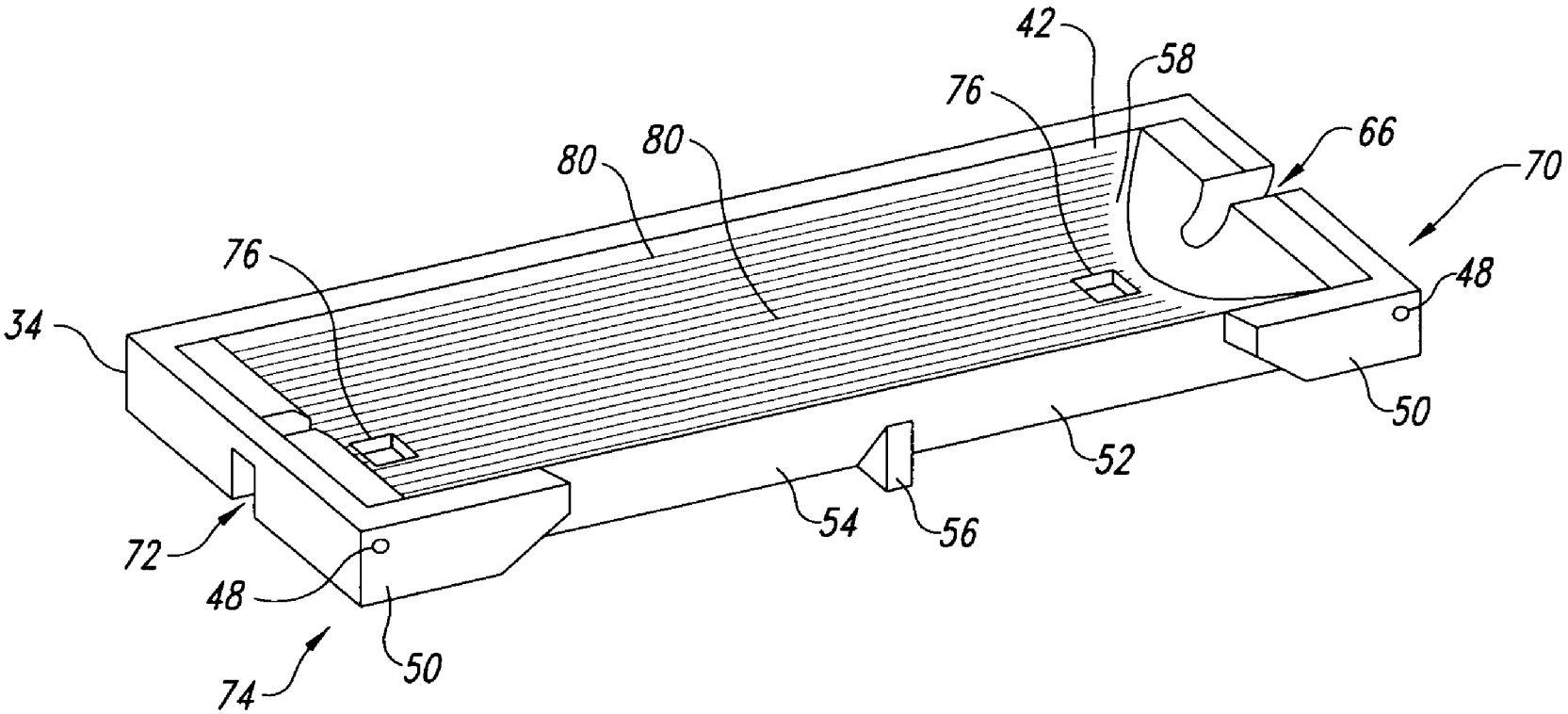
FIG. 5 is a bottom, right isometric view of an alternative embodiment of the channel member having a plurality of ridges in the channel.

FIG. 5 shows the channel member 34 including a plurality of ridges 80 in the bottom of the channel 42. This alternative embodiment, and those alternative embodiments and other alternatives described herein, are substantially similar to previously described embodiments, and common acts and structures are identified by the same reference numbers. Only significant differences in operation and structure are described in detail below.

While FIG. 5 shows the ridges generally running parallel to the longitudinal axis 57, the ridges can additionally, or alternatively run laterally along the bottom of the channel 42. The ridges 80 should partially penetrate the perimeter surface 40 of the canted coil spring conductor 36 to provide a better electrical connection between the conductive channel surface 58 and the canted coil spring conductor 36, to reduce the voltage drop across the electrical connector 16. This can be a particular asset where the circuits include gallium arsenide (GAs) ICs. The channel 42 can employ other protuberances for producing larger contact surface area or subsurface contact with the canted coil spring conductor 36.

Figure 6:
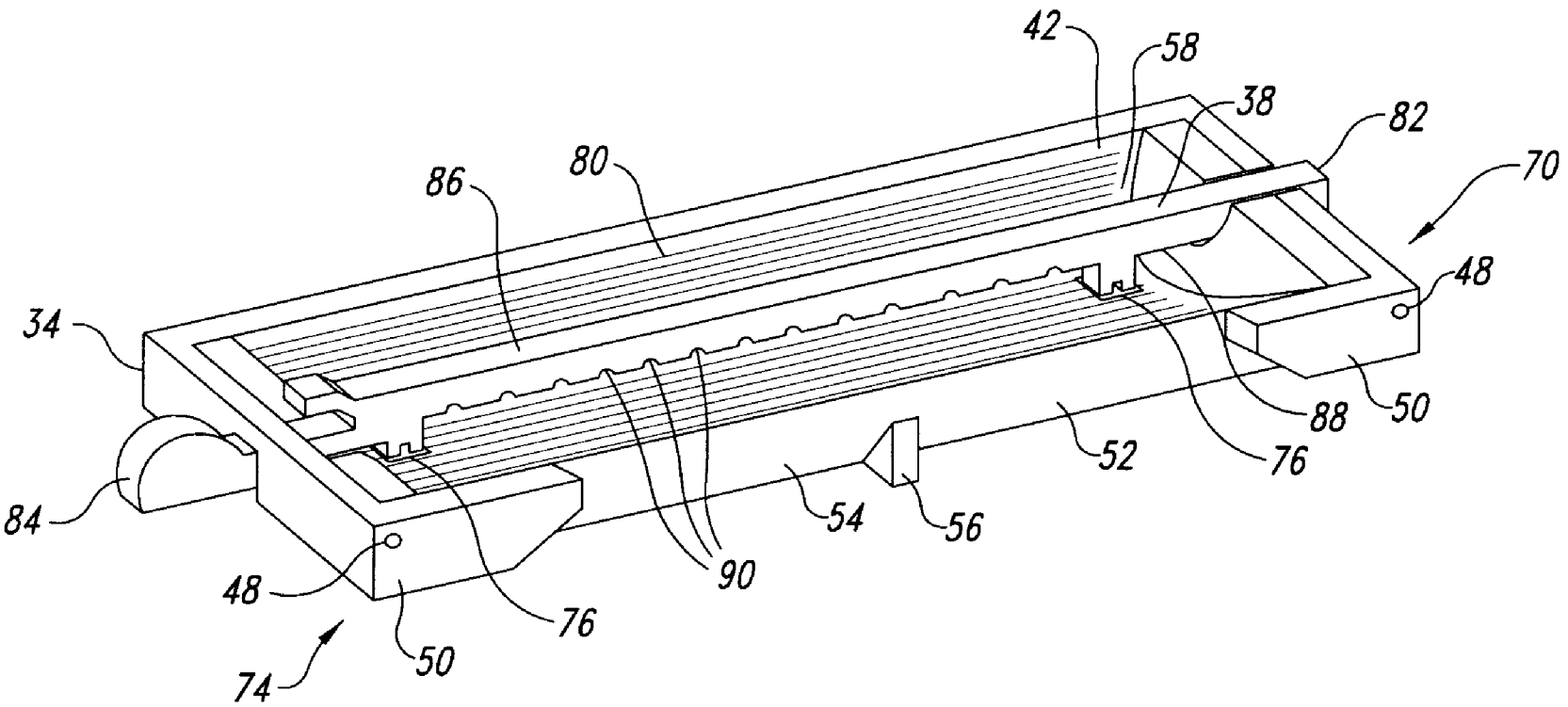
FIG. 6 is a bottom, right isometric view of the channel member and retainer, with the canted coil spring conductor removed to more clearly show the retainer engaging the channel member.
Figure 10:
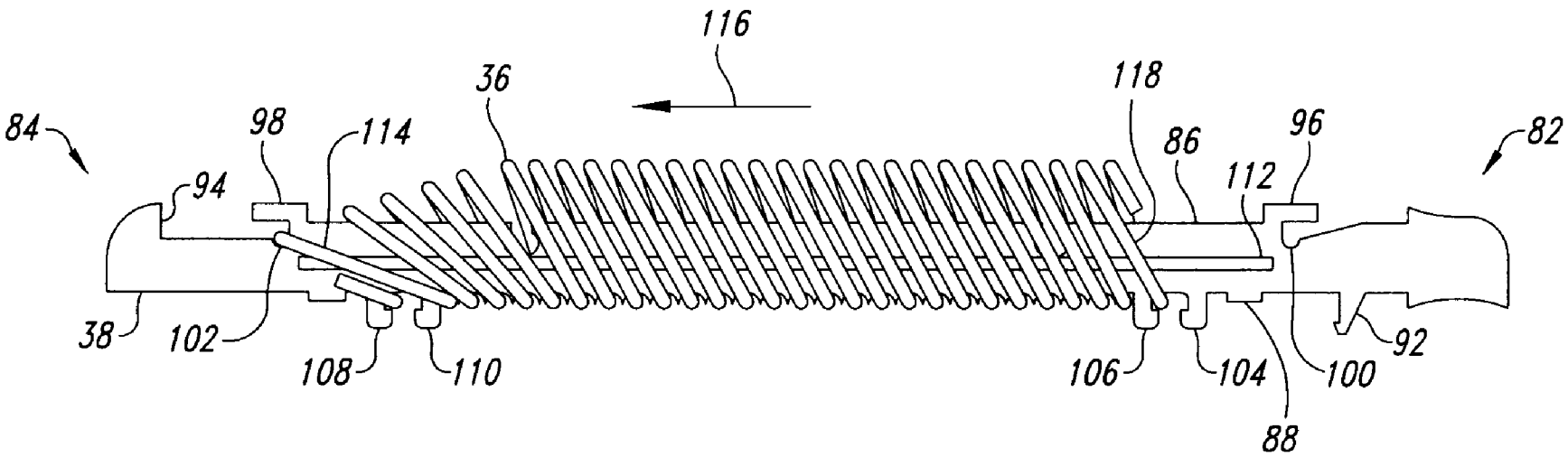
FIG. 10 is a side elevational view of the canted coil spring conductor received about the retainer.

FIG. 6 shows the retainer 38 having a first end 82 and a second end 84 securingly engaging the channel member 16. The finger 30 has the electrical contact 28 thereon of highly conductive material. The conductive metal contact surface 54 of the channel member 34 contacts the electrical contact 28 of the finger 30 to provide a low resistance, high current capability contact. When the contact is made, a high quality solder can be applied between the channel member 34 and the electrical contact 28 to ensure a solid mechanical, as well as electrical connection. The channel member 34, while clamped to the finger 30 of board 14 with the constant pressure clamp bar 44 of FIGS. 3 and 4A, helps prevent solder creep by the arrangement shown. The retainer 38 is an elongated member that can be formed from a variety of materials, for example plastic or epoxy bonded fiberglass. It is preferred that the retainer 38 be an electrical insulator. A top side 86 of the retainer 38 faces outward from the channel 42, while a bottom side 88 of the retainer 38 faces inward to the channel 42. The bottom side 88 of the retainer 38 includes a plurality of notches 90 sized to receive a respective one of the coils of the canted coil spring conductor 36 (FIG. 10).

Figure 7:
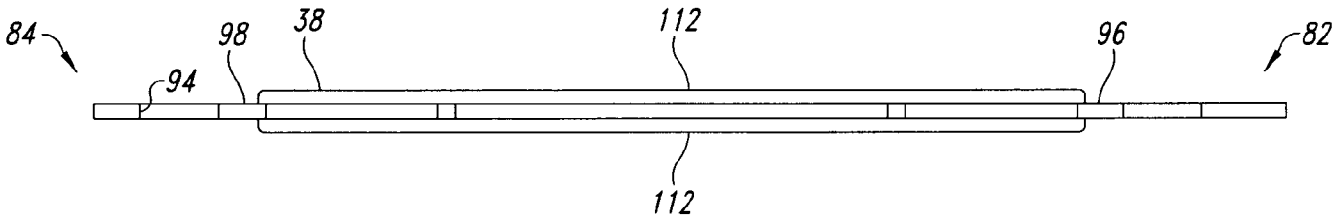
FIG. 7 is a top plan view of the retainer.
Figure 8:
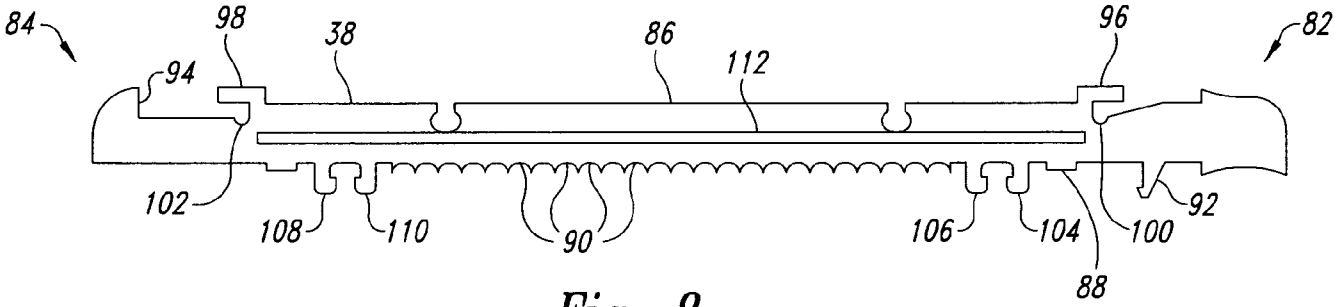
FIG. 8 is a side elevational view of the retainer.
Figure 9:
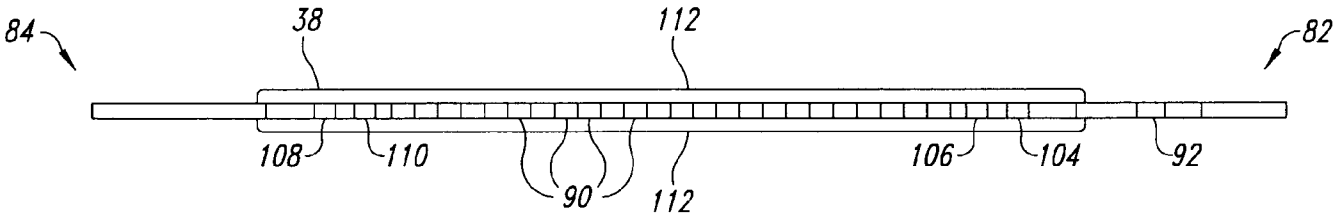
FIG. 9 is a bottom plan view of the retainer.

FIGS. 7–9 show the retainer 38 in particular detail. The forward end 82 of the retainer 38 includes a downward extending pawl 92 for securingly engaging the channel member 34 through the open slot 66 (FIG. 6). The rearward end 84 of the retainer 38 includes an upright lip 94 for securingly engaging the channel member 34 through the closed slot 72. The retainer 38 secures the canted coil spring conductor 36 along the longitudinal axis 57 in the channel 42 of the channel member 34. The pawl 92 allows the retainer 38 and canted coil spring conductor 36 to be removed and replaced, as required.

The retainer 38 includes a forward facing edge or lip 96 on the top side 86 of the retainer 38, close to the forward end 82, and a rearward facing edge or lip 98 on the top side 86 of the retainer 38, close to the rearward end 84. Each of the forward and rearward facing lips 96, 98 overlie a respective notch 100, 102 in the top side 86 of the retainer 38.

The retainer 38 also includes a first pair of opposed edges or lips 104, 106 on the bottom side 88 of the retainer 38, spaced inward from the forward facing lip 96 on the top side 86. The retainer 38 further includes a second pair of opposed edges or lips 108, 110 on the bottom side 88 of the retainer 38, spaced inward from the rearward facing lip 98 on the top side 86. The lips 96, 98, 104–110 on the top and bottom sides 86, 88 of the retainer 38, cooperate to retain the canted coil spring conductor 36 under tension, in a slightly elongated state, as best described with reference to FIGS. 10 and 11. Additionally, the retainer 38 can include a pair of wings 112, to increase the rigidity of the retainer 38.

Figure 11:
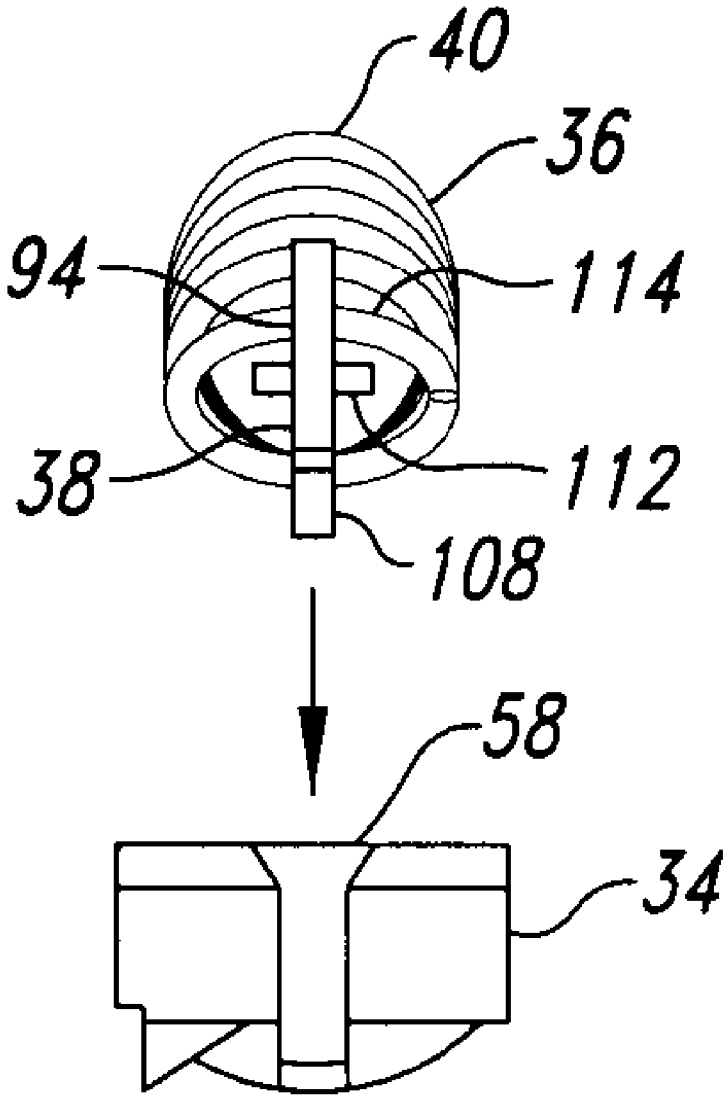
FIG. 11 is a rear elevational view of the canted coil spring conductor received about the retainer.

FIGS. 10 and 11 show the canted spring coil conductor 36 receiving the retainer 38 within a perimeter 40 of the canted coils. U.S. Pat. Nos. 5,092,781 and 5,069,626 each describe various aspects of canted coil springs. Canted coils springs are generally available through Bal-Seal Engineering Company, of Santa Ana, California. The canted coil spring conductor 36 is formed from a conductive material and can be plated with gold. The canted coil spring conductor 36 is particular suited to coupling power, and is not generally suited to coupling electrical data and/or controls signals due to the large area the cant coil spring occupies on the PCB 10.

The canted coil spring conductor 36 has a leading coil 114 (i.e., the first complete revolution of the canted coil spring conductor 36 in the direction of insertion 116 of the canted coil spring conductor 36 and the PCB 10). Similarly, the canted coil spring conductor 36 has a trailing coil 118 (i.e., the last complete revolution of the canted coil spring conductor 36 in the direction of insertion 116 for the canted coil spring conductor 36 and the PCB 10).

The leading coil 114 of the coil spring conductor 36 engages the rearward facing lip 98 on the top side 86 of the retainer 38. The leading coil 114 can rest in the notch 102, underlying the rearward facing lip 98. The leading coil 114 also engages the forward facing lip 108 of the pair of opposed lips 108, 110 on the bottom side 88 of the retainer 38, that are close to the rearward end 84. The rearward facing lip 98 on the top side 86 and forward facing lip 108 on the bottom side 88, thus hold the leading coil 114 substantially flat against the retainer 38 to prevent the canted coil spring conductor 36 from snagging as the PCB 10 is inserted between the power supplying substrates 12, 14. The forward facing lip 106 also retains the coil spring conductor 36 when the PCB 10 is removed from between the power supplying substrate 12, 14, in a direction opposite the direction of insertion 116. Similarly, the lip 96 may retain the other end of the spring 36 so that both sides are held firm and the spring is assured of being smoothly inserted into and removed from the slots shown in FIG. 1.

The rearward facing lip 110 of the pair of opposed lips 108, 110 close to the rearward end 84 of the retainer can also engage the leading coil. This further forces the leading coil, and a number of following coils, to lie relatively flat against the retainer 38.

The forward facing lip 106 of the pair of opposed lips 106, 104 on the bottom side 88 of the retainer 38 near the forward end 82 engages the trailing coil 118. The distance between the rearward facing lip 98 on the top side 86 and the forward facing lip on the bottom side 88 is such, that the canted coil string conductor 36 is slightly elongated from its undeformed state, placing the canted coil spring conductor 36 under tension. The deformed state may enhance the contact between canted coil spring conductor 36 and the conductive channel surface 58, distributing the pressure evenly about the length of the canted coil spring conductor 36.

Thus, the three lips 98, 108 and 106, and optionally the fourth lip 110, cooperate to retain the canted coiled spring conductor 36 under tension with the leading coil 114 against the retainer 38, where the direction of insertion 116 is towards the rearward end 84 of the retainer 38. The three lips 96, 104 and 110, and optionally the fourth lip 106, can cooperate to retain the canted coil spring conductor 36 under tension with the coil 118 relatively flat against the retainer 38 when the direction of insertion is opposite to the direction indicated by the arrow 116. The lips 96 and 104 engage the canted coil 118 (the leading canted coil when referenced with respect to the direction opposite the direction indicated by the arrow 116), while the lip 110 engages the canted coil 114 (the trailing canted coil when referenced with respect to the direction opposite the direction indicated by the arrow 116). Thus, the retainer 38 includes two sets of lips 96, 98, 104–110, to permit the electrical connector 16 to couple to either side 32 of the PCB 10.

Figure 12:
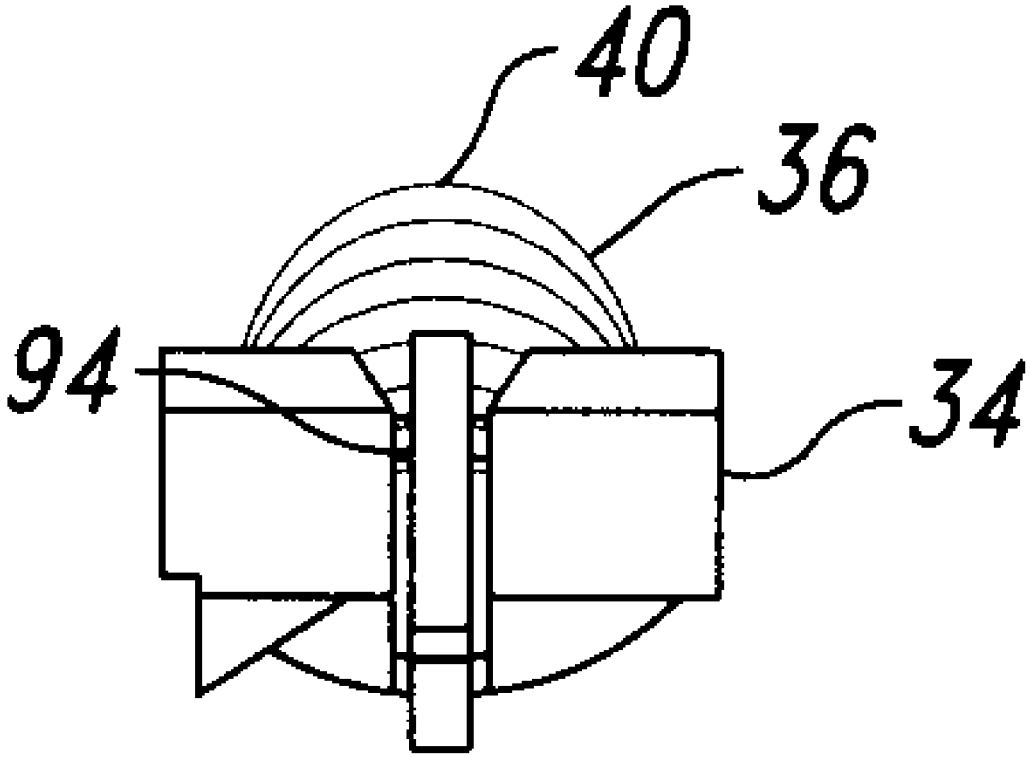
FIG. 12 is a rear elevation view of the canted coil spring conductor of FIG. 11 with the spring positioned in the channel member 34.

In particular, FIG. 11 shows the elliptical contour or cross-section of the conductive channel surface 58 of the channel member 34 that matches the perimeter 40 of the canted coil spring conductor 36. Thus, when the spring 36 is compressed into the channel surface 58, it is a contoured match to provide a highly conductive electrode contact. FIG. 12 shows the spring 36 within the channel member 34 as indicated by the arrow from FIG. 11 in a fully assembled position.

Although specific embodiments of and examples for, the invention are described herein for illustrative purposes, various equivalent modifications can be made without departing from the spirit and scope of the invention, as will be recognized by those skilled in the relevant art. The teachings provided herein of the invention can be applied to other electrical connectors, not necessarily the exemplary clamping electrical connector generally described above. For example, the contact surface and channel surface can be discrete, separately defined elements carried by an insulating channel member and coupled by some conductor such as a conductive trace. The electrical conductor can employ channel shapes other than the elliptical cross-section generally shown. The electrical connector can be fastened to portions of the circuit substrate other than a finger, or an edge, and can be fastened using fasteners other than the threaded fastener and clamping member combination generally disclosed. A large number of suitable fasteners are known in the art.

The various embodiments described above can be combined to provide further embodiments. All of the above U.S. patents, patent applications and publications referred to in this specification are incorporated by reference. Aspects of the invention can be modified, if necessary, to employ systems, circuits and concepts of the various patents, applications and publications to provide yet further embodiments of the invention.

These and other changes can be made to the invention in light of the above-detailed description. In general, in the following claims, the terms used should not be construed to limit the invention to the specific embodiments disclosed in the specification and the claims, but should be construed to include all connectors and clamping devices that operate in accordance with the claims. Accordingly, the invention is not limited by the disclosure, but instead its scope is to be determined entirely by the following claims.

We claim:

1. An electrical connector to couple electrical surfaces, the electrical connector comprising:

a canted coil spring conductor having a plurality of canted coils; and a conductive channel member having a first end and a second end, the conductive channel member partially receiving the canted coil spring conductor, at least a portion of the canted coil spring conductor in electrical contact with a plurality of ridges of the conductive channel member.

2. An electrical connector to couple electrical surfaces, comprising:

a canted coil spring conductor having a plurality of canted coils;

a conductive channel member having a first end and a second end, the conductive channel member partially receiving the canted coil spring conductor, at least a portion of the canted coil spring conductor in electrical contact with the conductive channel member;

a clamping member; and at least one adjustment member selectively engaging the clamping member and the channel member to secure the channel member to a circuit substrate.

3. An electrical power connector to couple circuits on non-parallel surfaces, comprising:

an elongated channel member forming a conductive channel including an opening in a first plane, the channel member also forming a conductive contact face in a second plane, at an angle to the first plane, where the conductive contact face is in electrical communication with the conductive channel;

a canted coil spring conductor received in the conductive channel, a portion of the canted coil spring conductor in electrical communication with the conductive channel and a portion of the canted coil spring conductor extending out of the opening, the canted coil spring conductor having a plurality of canted coils; and a retainer received through a circumference of the canted coil spring conductor, the retainer having a plurality of notches along a portion of a length thereof, each of the notches engaging a respective one of the plurality of canted coils against the conductive channel.

4. An electrical power connector to couple circuits on non-parallel surfaces, comprising:

an elongated channel member forming a conductive channel including an opening in a first plane, the channel member also forming a conductive contact face in a second plane, at an angle to the first plane, where the conductive contact face is in electrical communication with the conductive channel;

a canted coil spring conductor received in the conductive channel, a portion of the canted coil spring conductor in electrical communication with the conductive channel and a portion of the canted coil spring conductor extending out of the opening; and an elongated retainer received through a circumference of the canted coil spring conductor, the retainer having a forward facing lip on a first side of the retainer engaging a portion of an end coil of the canted coil spring conductor, and the retainer also having a rearward facing lip on a second side of the receiver, opposite the first side, and engaging another portion of the end coil to retain the end coil substantially flat against the elongated retainer.

5. An electrical power connector to couple circuits on non-parallel surfaces, comprising:

an elongated channel member forming a conductive channel including an opening in a first plane, the channel member also forming a conductive contact face in a second plane, at an angle to the first plane, where the conductive contact face is in electrical communication with the conductive channel;

a canted coil spring conductor received in the conductive channel, a portion of the canted coil spring conductor in electrical communication with the conductive channel and a portion of the canted coil spring conductor extending out of the opening; and an elongated retainer received through a circumference of the canted coil spring conductor, the retainer having a notch on a first side of the retainer receiving a portion of an end coil of the canted coil spring conductor, the retainer also having a forward facing lip opposed over the notch and retaining the portion of the end coil in the notch, and the retainer further having a rearward facing lip on a second side of the receiver, opposite the first side, and engaging another portion of the end coil to retain the end coil substantially flat against the elongated retainer.

6. An electrical power connector to couple circuits on perpendicular electrical surfaces, comprising:

a concave conductive surface forming an opening thereacross;

a planar conductive surface at least approximately perpendicular to the opening of the concave conductive surface, the planar conductive surface in electrical communication with the concave conductive surface;

a single spring conductor having a plurality of canted coils, a number of the canted coils in electrical communication with the concave conductive surface and a number of the canted coils having a portion extending beyond the opening of the concave conductive surface; and an elongated retainer received through the plurality of canted coils and securingly engaging at least a first portion of the concave conductive surface.

7. An electrical power connector to couple circuits on perpendicular electrical surfaces, comprising:

a concave conductive surface forming an opening thereacross;

a planar conductive surface at least approximately perpendicular to the opening of the concave conductive surface, the planar conductive surface in electrical communication with the concave conductive surface;

a single spring conductor having a plurality of canted coils, a number of the canted coils in electrical communication with the concave conductive surface and a number of the canted coils having a portion extending beyond the opening of the concave conductive surface; and an elongated retainer received through a circumference of the spring conductor, the retainer having a forward end, a rearward end, a top side and a bottom side opposed to the top side, a notch on the top side of the retainer proximate the forward end receiving a portion of a forward end coil of the spring conductor, a forward facing lip opposed over the notch retaining the portion of the forward end coil in the notch, and a rearward facing lip on the bottom side engaging another portion of the forward end coil to retain the forward end coil substantially flat against the retainer proximate the forward end.

8. The electrical power connector of claim 7 wherein the retainer further comprises:

a rearward facing lip on the bottom side of the retainer proximate the rearward end thereof, the rearward facing lip engaging a portion of another end coil of the spring conductor to retain the spring conductor in tension.

9. An electrical connector to couple electrical surfaces, comprising:

a canted coil spring conductor having a plurality of canted coils;

a conductive channel member having a first end and a second end, the conductive channel member partially receiving the canted coil spring conductor, at least a portion of the canted coil spring conductor in electrical contact with the conductive channel member; and a retainer received through a circumference of the plurality of canted coils of the canted coil spring conductor and securely engaging the conductive channel member.

10. The electrical connector of claim 9 wherein the retainer engages the first and the second ends of the conductive channel member.

11. The electrical connector of claim 9 wherein the retainer has a plurality of notches along a length thereof, each of the notches engaging a respective one of the plurality of canted coils.

12. The electrical connector of claim 9 wherein the retainer has a first retaining edge at a first end and a second retaining edge at a second end, the first retaining edge securingly engaging the canted coil spring conductor proximate a first end thereof and the second retaining edge securingly engaging the canted coil spring conductor proximate a second end thereof, where the canted coil spring conductor is stretched between the first and the second retaining edges to hold the canted coil spring conductor in tension.

13. An electrical power connector to coupled circuits on nonparallel surfaces, comprising:

a conductive channel member forming a channel having a longitudinal channel axis;

a single canted coil spring conductor received in the channel along the longitudinal channel axis, a portion of a circumference of the canted coil spring conductor extending out of the channel to contact a power supplying surface and a portion of the circumference of the canted coil spring conductor electrically contacting the conductive channel member within the channel; and a retainer received through a circumference of the canted coil spring conductor and securingly engaging first and second ends of the conductive channel member.

14. The electrical power connector of claim 13 wherein the retainer has a plurality of notches along a portion of a length thereof, each of the notches engaging a respective one of the plurality of canted coils against the conductive channel member.

15. The electrical power connector of claim 13 wherein the retainer engages the conductive channel member to position the canted coil spring conductor in the channel of the channel member, a first portion of the retainer engaging the canted coil spring conductor proximate a first end thereof and a second portion of the retainer engaging the canted coil spring conductor proximate a second end thereof while the canted coil spring conductor is in tension.

16. The electrical power connector of claim 13 wherein the channel of the conductive channel member has a contour that matches the shape of the portion of the canted coil spring conductor electrically contacting the conductive channel member.

* * * * *